US006453136B1

(12) United States Patent
Yasumaru

(10) Patent No.: US 6,453,136 B1
(45) Date of Patent: Sep. 17, 2002

(54) IMAGE FORMING APPARATUS COMPRISING A PLURALITY OF IMAGE BEARING MEMBER UNITS, FIRST AND SECOND IMAGE BEARING MEMBERS, OR FIRST AND SECOND UNITS PROVIDED WITH FIRST AND SECOND IMAGE BEARING MEMBERS, RESPECTIVELY

(75) Inventor: Ichiro Yasumaru, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/722,549

(22) Filed: Nov. 28, 2000

(30) Foreign Application Priority Data

Nov. 30, 1999 (JP) ..... 11-338975
Nov. 30, 1999 (JP) ..... 11-338977
Nov. 27, 2000 (JP) ..... 2000-358904

(51) Int. Cl.[7] ..... G03G 21/16; G03G 15/02
(52) U.S. Cl. ..... 399/111; 399/116
(58) Field of Search ..... 399/107, 110, 399/111, 112, 116, 117, 126

(56) References Cited

U.S. PATENT DOCUMENTS 5,014,094 A * 5/1991 Amitani et al. ..... 399/112 X
5,365,315 A * 11/1994 Baker et al. ..... 399/111
5,440,373 A * 8/1995 Deki et al. ..... 399/112 X
5,543,891 A * 8/1996 Setoriyama ..... 399/111
5,734,949 A * 3/1998 Goto et al. ..... 399/111

* cited by examiner

*Primary Examiner*—Sandra Brase
(74) *Attorney, Agent, or Firm*—Fitzpatrick, Cella, Harper & Scinto

(57) ABSTRACT

An image bearing apparatus includes an image bearing member unit provided with an image bearing member. An image on the image bearing member is transferred to a transfer medium. The apparatus also includes an openable and closable unit openable and closable to mount the image bearing member on and to dismount the image bearing member unit from the main body of an image forming apparatus. The openable and closable unit regulates the position of the image bearing member unit.

49 Claims, 8 Drawing Sheets

IMAGE FORMING APPARATUS COMPRISING A PLURALITY OF IMAGE BEARING MEMBER UNITS, FIRST AND SECOND IMAGE BEARING MEMBERS, OR FIRST AND SECOND UNITS PROVIDED WITH FIRST AND SECOND IMAGE BEARING MEMBERS, RESPECTIVELY

BACKGROUND OF THE INVENTION

1. Field of the Invention

This invention relates to an image forming apparatus using the electrophotographic method, and particularly to an image forming apparatus such as a copier, a printer or a facsimile apparatus.

2. Related Background Art

Heretofore, in an image forming apparatus capable of polychromatic printing such as a color printer or a color copier, the positions of a plurality of detachably mountable process cartridges having photosensitive drums, etc., and an optical unit having an optical system for applying light conforming to image information to each photosensitive drum have been determined by front and rear side plates forming the frame of the main body of the apparatus.

Of these side plates, the rear side plate is provided with a driving portion for driving the process cartridges, and a portion of the front side plate is provided with an opening portion for effecting the interchange of the process cartridges. By this opening portion of the front side plate provided to interchange the process cartridges, a holding portion in one region of a process cartridge, when the process cartridge is inserted, is lost, but the design is made such that the process cartridge can be held by a holding plate or the like discrete from this side plate.

This holding plate is provided for each of the plurality of process cartridges, and each holding plate has incorporated therein an adjusting mechanism or the like for holding the shaft of the photosensitive drum of the process cartridge at a predetermined position.

The optical units corresponding to these adjusting mechanisms of the holding plates are incorporated by throwing in, and for these optical units, many means for effecting the adjustment of the process cartridges have been proposed.

Also, in a case where a plurality of process cartridges are held by a holding plate, there is incorporated a mechanism for holding the process cartridges at a predetermined position in vertical and horizontal directions with the shaft the photosensitive drum as the reference.

In the above-described construction according to the prior art, in order to form a color image, an adjusting mechanism for the plurality of process cartridges is necessary, and a mechanism for adjusting each of the process cartridges of black (hereinafter abbreviated as K), yellow (hereinafter abbreviated as Y), magenta (hereinafter abbreviated as M) and cyan (hereinafter abbreviated as C) is incorporated and constructed.

These process cartridges, when inserted and mounted from the aforedescribed opening portion of the front side plate, are mounted with the driving portion of the fixed rear side plate as the reference, and further the position of each process cartridge is adapted to be regulated by a holding plate provided near the opening portion of the front side plate.

In the above-described construction according to the conventional art, however, the holding plate and the driving portion of the rear side plate exhibit positional deviation due to the accumulation of the tolerances of parts and therefore, as a matter of course, the positions of adjacent ones of the process cartridges are irregular within the range of the tolerance and further, when an optical system for applying light (image light) to the photosensitive drums is mounted, the irradiated positions on the photosensitive drums exhibit positional deviation.

Also, in order to correct the positional deviation of these process cartridges and the optical system, various correcting mechanisms and adjusting mechanisms are incorporated on the holding plate, and particularly if an attempt is made to raise a process cartridge when the longitudinal positional relation between the optical unit and the process cartridge is to be adjusted, the holding mechanism receives the weight of the process cartridge, and if an attempt is made to raise the plurality of process cartridges at one time, the load applied to the holding mechanism becomes great, and operability has sometimes become poor.

SUMMARY OF THE INVENTION

It is an object of the present invention to provide an image forming apparatus which enables the regulation of the position of an image bearing member unit to be accomplished easily, that is, which improves usability.

It is another object of the present invention to provide an image forming apparatus in which the load when a supporting member is moved can be mitigated.

Further objects of the present invention will become apparent by reading the following detailed description.

DESCRIPTION OF THE PREFERRED EMBODIMENTS

Some embodiments of an image forming apparatus to which the present invention is applied will hereinafter be described in detail with reference to the drawings. In the following embodiments, an image forming apparatus of the electrophotographic type capable of effecting full color image formation is shown by way of example.

Figure 1:
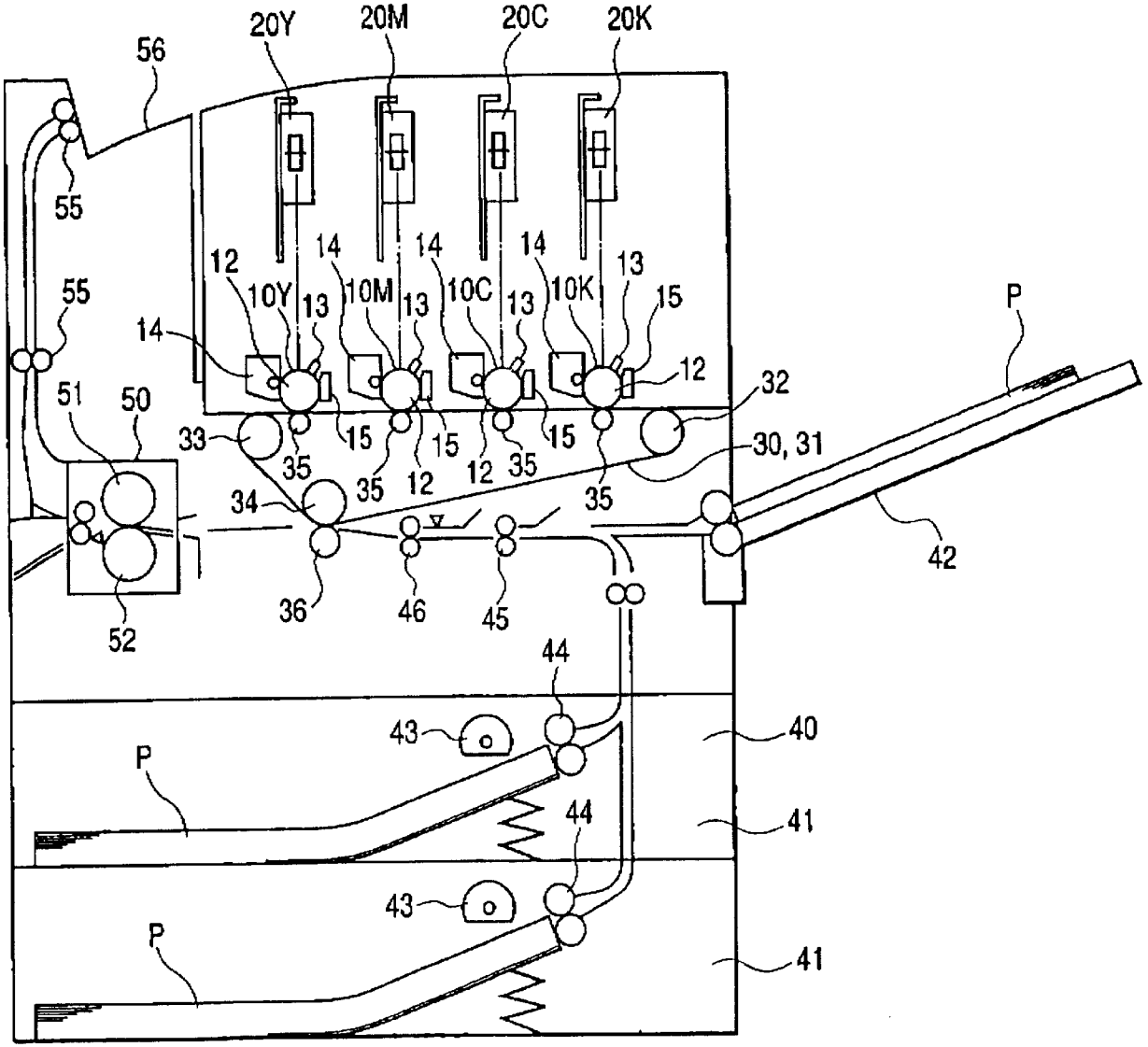
FIG. 1 illustrates a color image forming apparatus.

An image forming apparatus according to a first embodiment of the present invention will hereinafter be described in detail with reference to FIGS. 1 to 6. With reference first to FIG. 1, the schematic construction of the color image forming apparatus according to the present embodiment will be described. FIG. 1 is a typical cross-sectional view schematically showing the construction of the full color image forming apparatus according to the first embodiment.

As shown in FIG. 1, the color image forming apparatus according to the present embodiment is such that process cartridges 10Y, 10M, 10C and 10K of four colors, which are image bearing member units, are detachably mountable on corresponding image forming stations, and is provided with optical units 20Y, 20M, 20C and 20K as exposing means capable of applying a laser beam, an intermediate transfer member unit 30, a recording material conveying unit 40, and a fixing unit 50.

The process cartridges 10Y, 10M, 10C and 10K are of the same structure, and each of them is integrally comprised of a photosensitive drum (electrophotographic photosensitive member) 12 as an image bearing member, and as process means for acting thereon, charging means 13 for charging the surface of the photosensitive drum, developing means 14 for developing a latent image formed on the photosensitive drum, and cleaning means 15 for removing any developer or the like residual on the photosensitive drum. Also, each process cartridge is detachably mountable to the main body of the image forming apparatus in the opening and closing direction of an openable and closable cover unit which will be described later (the axial direction of the rotary shaft of the photosensitive drum).

The intermediate transfer member unit 30 is provided with a transfer belt 31 as a transfer medium (intermediate transfer member), three rollers 32, 33 and 34 rotatably supporting the transfer belt 31, a primary transfer roller 35 for transferring a toner image formed on each photosensitive drum 12 to the transfer belt 31, and a secondary transfer roller 36 for further transferring the toner image transferred onto the transfer belt 31 to a recording material P.

The recording material conveying unit 40 is provided with a pickup roller 43 for conveying the recording material P from each feed cassette 41 or a feed tray 42 to a secondary transfer area, feed rollers 44, conveying rollers 45 and registration rollers 46.

The fixing unit 50 is provided with a fixing roller 51 and a pressure roller 52, and applies heat and pressure to the toner image on the recording material P to thereby effect fixing.

In the above-described construction, in the process cartridge 10K of the first color, e.g. black, the photosensitive drum 12 is uniformly charged by the charging means 13, whereafter a latent image is formed by a laser beam applied from the optical unit 20K, and this latent image is developed by the developing means 14 and a toner image is formed.

The toner image formed on the photosensitive drum 12 is primary-transferred onto the transfer belt 31 by the action of the primary transfer roller 35. After the termination of the primary transfer, the photosensitive drum 12 is cleaned by the cleaning means 15 and is used for the next image formation.

Similar image forming processes are also carried out in the process cartridges 10Y; 10M and 10C for Y, M and C, whereby toner images of the respective colors are formed, and are sequentially superimposed on the previously formed toner image and transferred.

On the other hand, the recording material P is conveyed from the feed cassette 41 or the feed tray 42 to the secondary transfer area by the recording material conveying unit 40, and the toner images formed on the transfer belt 31 are transferred to the recording material P by the action of the secondary transfer roller 36. The recording material P to which the toner images have been transferred is conveyed to the fixing unit 50, and the toner images thereon are fixed in the nip portion between the fixing roller 51 and the pressure roller 52 of the fixing unit 50, and the recording material P is discharged onto a discharge tray 56 by discharge rollers 55.

The mounting construction for the process cartridges 10Y, 10M, 10C and 10K, which is the characteristic portion of the present invention, will now be described with reference to FIGS. 2 to 6. As described above, the process cartridges are of the same structure and therefore, in the following description, each process cartridge will be described as the process cartridge 10.

Figure 2:
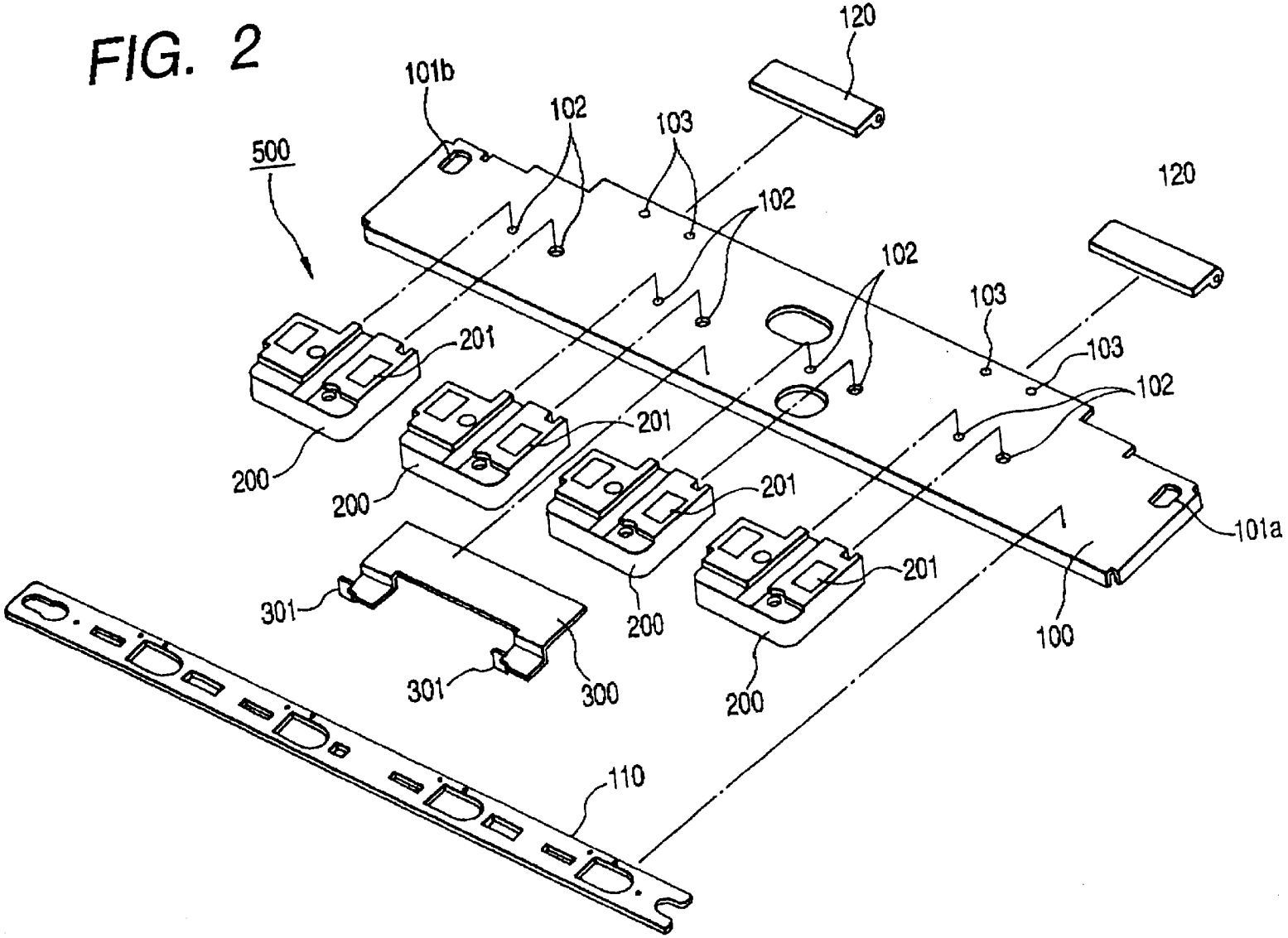
FIG. 2 illustrates the construction of an openable and closable cover.

FIG. 2 shows an openable and closable cover unit 500 as an openable and closable unit, and in FIG. 2, the reference numeral 100 designates an openable and closable cover, the reference characters 101*a* and 101*b* denote first reference apertures in the openable and closable cover 100, the reference numeral 102 designates positioning apertures in CRG receivers 200, and the reference numeral 103 denotes positioning apertures for openable and closable cover hinge bearings 120. Also, the reference numeral 110 designates an operating plate which is second holding means, the reference numeral 120 denotes openable and closable cover hinge bearings, the reference numeral 200 designates CRG receivers which are first holding means, and the reference numeral 300 denotes a lock plate which is restraining means.

The openable and closable cover unit 500 is openably and closably provided near an opening portion 61 provided in a first side plate 60 which is the aforementioned front side plate for mounting and dismounting the process cartridge 10, and is capable of holding the process cartridge 10 when inserted from the opening portion 61.

The disposition of respective parts mounted on the openable and closable cover 100 which constitute the openable and closable cover unit 500 will now be described with reference to FIG. 2. First, the openable and closable cover hinge bearings 120 are screwed with the positioning apertures 103 of the openable and closable cover 100 as the reference. The positioning apertures 102 of the openable and closable cover 100 are accurately centered with the first reference aperture 101*a* as the reference, and the mounting shafts (not shown) of the CRG receivers 200 as regulating members are fitted to these positioning apertures 102, and the CRG receivers 200 are screwed. Thereby, the CRG receivers 200 are accurately mounted on the openable and closable cover 100 with the first reference aperture 101*a* as the reference. On the other hand, the operating plate 110 as a supporting member is disposed so as to operate on the openable and closable cover 100 inside the bearing portions 201 of the CRG receivers 200. Also, the lock plate 300 is mounted so as to slide to the left and right on the openable and closable cover 100, and is always biased and held in a predetermined direction by a spring, not shown. The lock plate 300 has pawl restraining portions 301, and these pawl restraining portions 301 are engaged with lock pawls 302 (see FIG. 5) attached to the first side plate 60 which is the front side plate, whereby the openable and closable cover unit 500 is mounted on the first side plate 60.

The opening and closing operation of the openable and closable cover unit 500 will now be described with reference to FIGS. 3 and 4.

Figure 3:
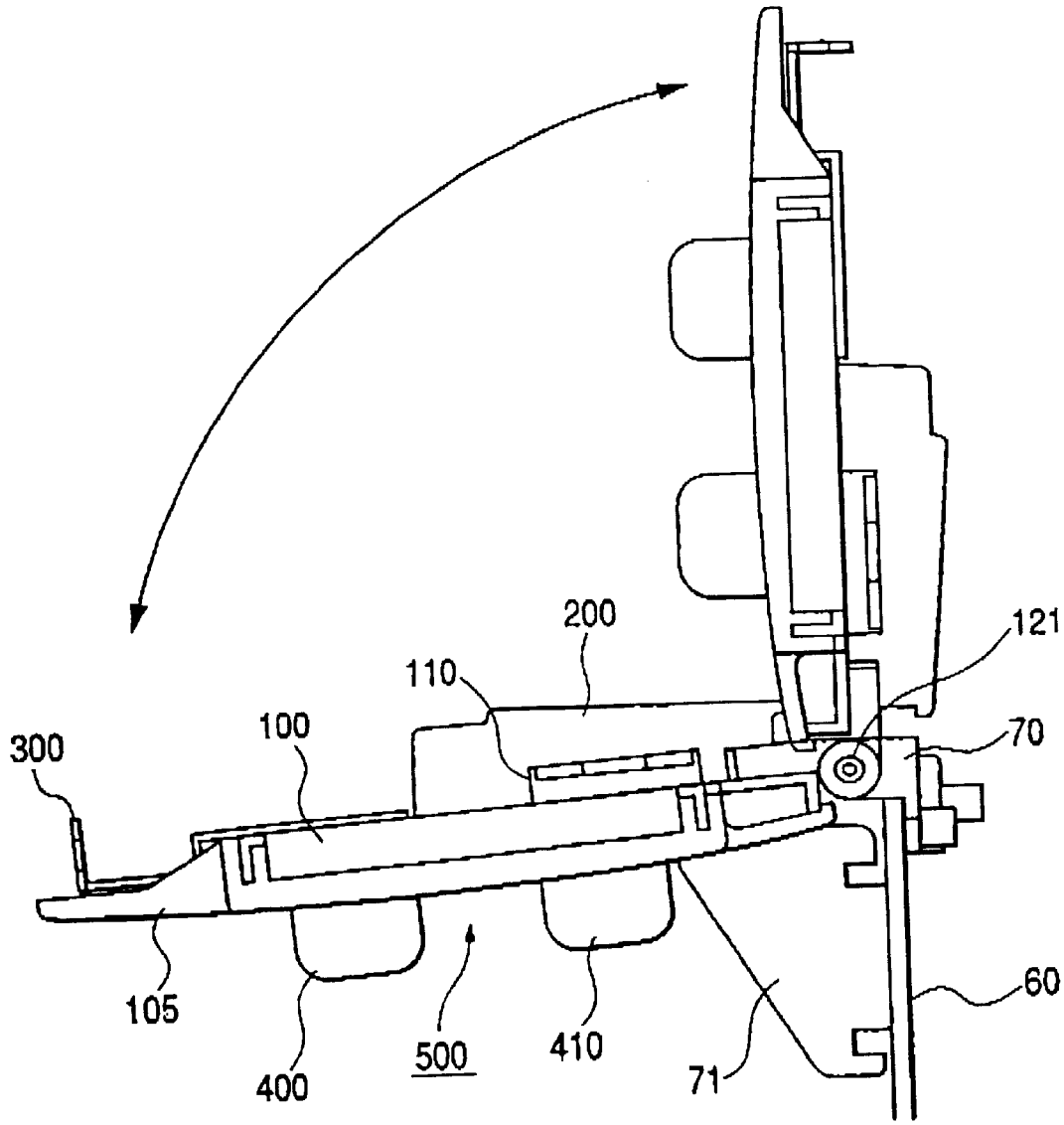
FIG. 3 illustrates the relation between the openable and closable cover and a hinge bearing.

In FIG. 3, a side plate hinge shaft 70 mounted on the first side plate 60 by screwing and the openable and closable cover hinge bearings 120 (see FIG. 2) of the openable and closable cover unit 500 are rotatably mounted by means of a hinge shaft 121. Also, an openable and closable cover receiver 71 is attached to the first side plate 60 and provides a stopper when the openable and closable cover unit 500 is opened and therefore, when the opening operation of the openable and closable cover unit 500 is performed, the position, when a portion of the exterior package 105 of the openable and closable cover 100 is rammed against the openable and closable cover receiver 71 and is opened, is determined (regulated).

Figure 4:
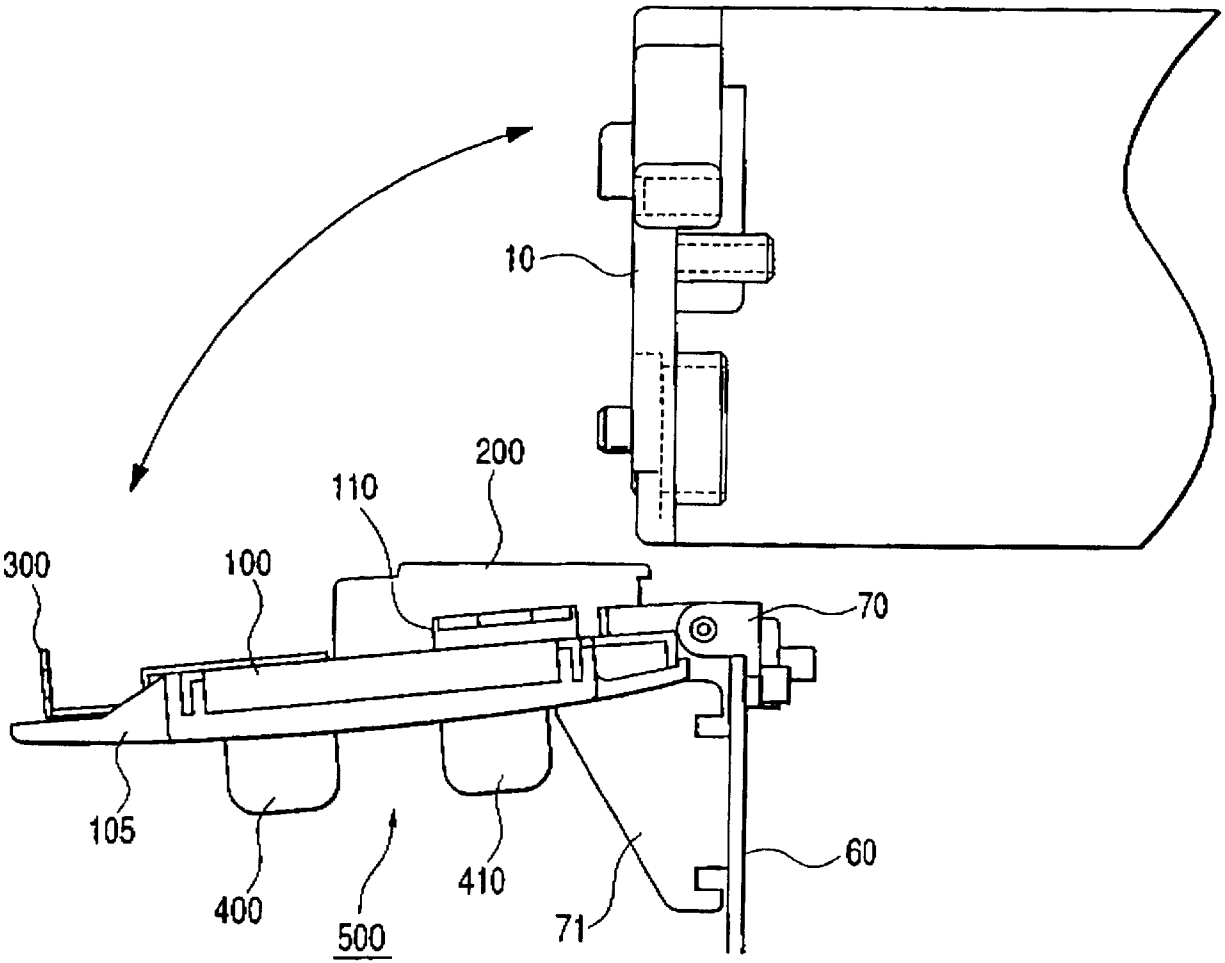
FIG. 4 illustrates the relation between the openable and closable cover and the hinge bearing.

Also, when as shown in FIG. 4, the operable and closable cover unit 500 (a portion of the exterior package 105 thereof) is rammed against the openable and closable cover receiver 71, the openable and closable cover unit 500 is adapted to be opened by 90° or greater with the first side plate 60 as the reference so that the mounting or dismounting of the process cartridge 10 can be accomplished easily.

Also, operating levers 400 and 410 protruding from the exterior package 105 (the exterior package 105 may form a portion of the outer wall of the main body of the image forming apparatus) are constructed on the openable and closable cover unit 500. In FIG. 4, the reference numeral 400 designates a first operating lever operatively associated with the lock plate 300 and adapted to be released when the lock plate 300 is assembled to the main body, and the reference numeral 410 denotes a second operating lever operatively associated with the operating plate 110 and capable of moving the operating plate 110 to the left and right.

Figure 5:
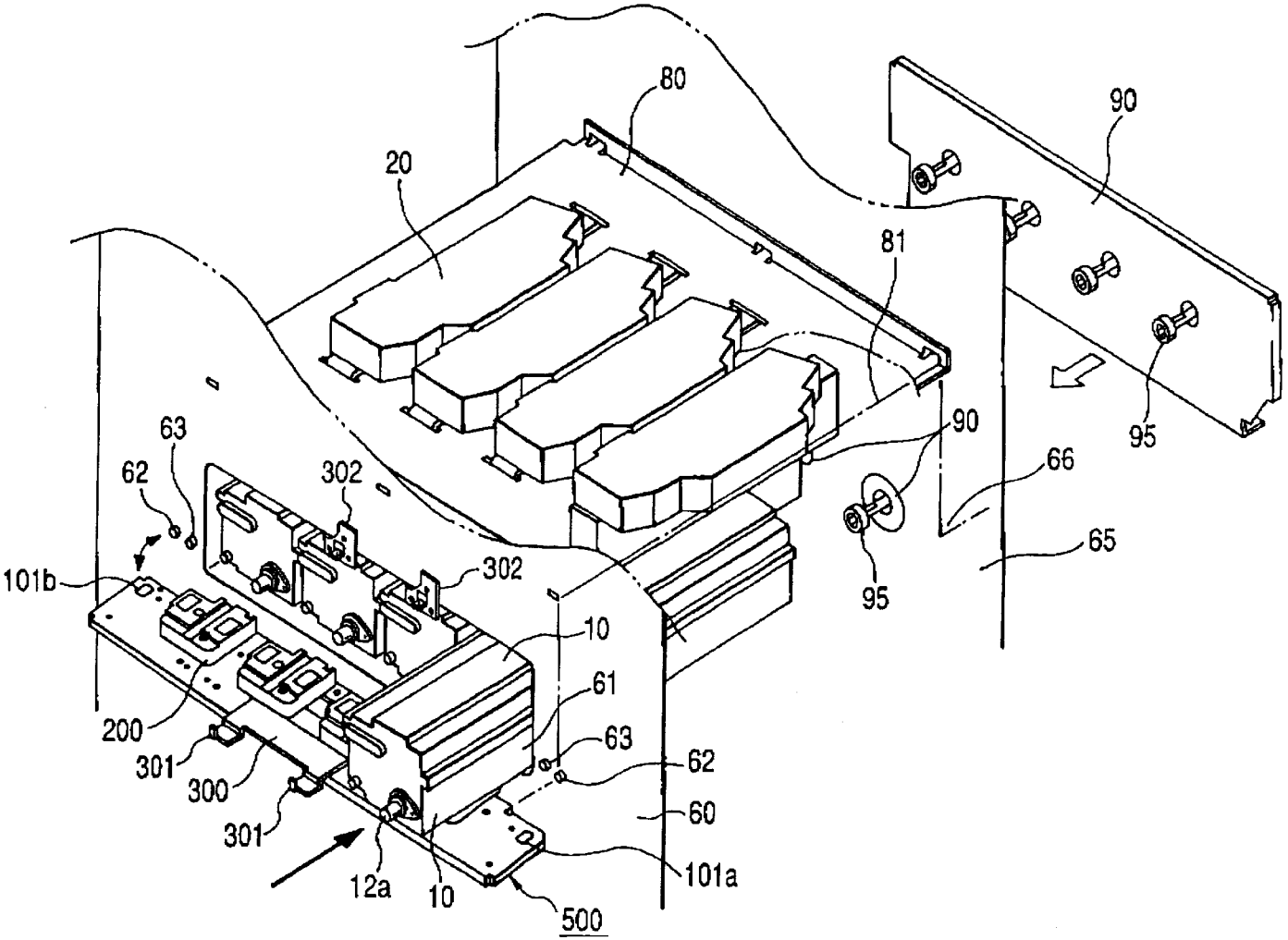
FIG. 5 illustrates the positional relation between the openable and closable cover and a side plate.

Reference is now had to FIG. 5 to describe the mounting reference when the openable and closable cover unit 500 is mounted on the first side plate 60.

First, the first side plate 60 is provided with an opening portion 61 for enabling the process cartridges 10 to be arranged in a lateral direction (the direction of conveyance of the recording material) and mounted and dismounted. As a matter of course, an insertion guide is necessary when these process cartridges 10 are to be inserted into the main body of the apparatus, and guide rails, not shown, are provided above the opening portion 61 so as to correspond to the respective process cartridges, and the process cartridges 10 are inserted into the main body of the apparatus along these guide rails. When the process cartridges are inserted into the main body of the apparatus, the drive connecting portion of each process cartridge 10 is connected to each coupling 95 of driving units 90 disposed on the second side plate 65 side. Thus, the process cartridge 10 receives a driving force from a driving unit 90. The driving unit 90 having the coupling 95 is mounted with a third reference shaft (a position 66 in FIG. 5) provided on the second side plate 65 as the reference, and the coupling 95 is also accurately disposed with this third reference shaft as the reference and therefore, the positions of the couplings 95 are accurately disposed on the third reference shaft of the second side plate 65.

In this state, the non-driving side (the opening portion 61 side) of the process cartridge 10 is not held and thus, is held by the openable and closable cover unit 500.

On the other hand, the positioning of the openable and closable cover unit 500 to the first side plate 60 is effected as follows. A first reference shaft 62 and a second reference shaft 63 are disposed on the first side plate 60. First, the first reference shaft 62 is screwed to the lengthwisely opposite sides of the opening portion 61 of the first side plate 60, and the second reference shaft 63 is likewise screwed to the inside thereof (toward the opening portion 61). The first reference aperture 101*a* of the openable and closable cover 100 is fitted on the first reference shaft 62, and the first reference aperture 101*b* of the openable and closable cover 100 comes onto the other first reference shaft 62, but the openable and closable cover unit 500 slides to the left and right (the direction in which the process cartridges are arranged) by an amount corresponding to the play with the portions of the respective hinge bearings as the fulcrum and therefore, this other first reference aperture 101*b* is not fitted but provides a guide. Thus, the openable and closable cover unit 500 has its position in the left to right direction determined by the fitting between the first reference shaft 62 and the first reference aperture 101*a*.

Also, as previously described, when the openable and closable cover unit 500 is closed by the opening and closing operation of this unit, the lock plate 300 (the pawl restraining portion 301 thereof) comes into engagement with the lock pawl 302 attached to the first side plate 60, whereby the openable and closable cover unit 500 is mounted with the first reference shaft 62 of the first side plate 60 as the reference. Also, to perform the opening and closing operation of the openable and closable cover unit 500, the first operating lever 400 is operated, whereby the lock plate 300 is slid in the left to right direction and therefore, the lock (the engagement with the lock pawl) can be released.

By the above-described construction, the openable and closable cover unit 500 is accurately mounted on the first side plate 60 by the first reference aperture 101*a* being fitted-on the first reference shaft 62. Also, this first reference shaft 62 and the third reference shaft of the second side plate 65, as shown in FIG. 5, are disposed on the same line (81 in FIG. 5) as the mounting reference of an optical stay 80 having a plurality of optical units and therefore, are disposed so as to be capable of minimizing their respective mounting tolerances. When the shaft 12*a* of the photosensitive drum 12 which is the non-driving side of the process cartridge 10 connected to the coupling 95 of the driving unit 90 is held by the openable and closable cover unit 500, it becomes possible to center it accurately by the bearing portion 201 of the CRG receiver 200 of the openable and closable cover 100.

Figure 6:
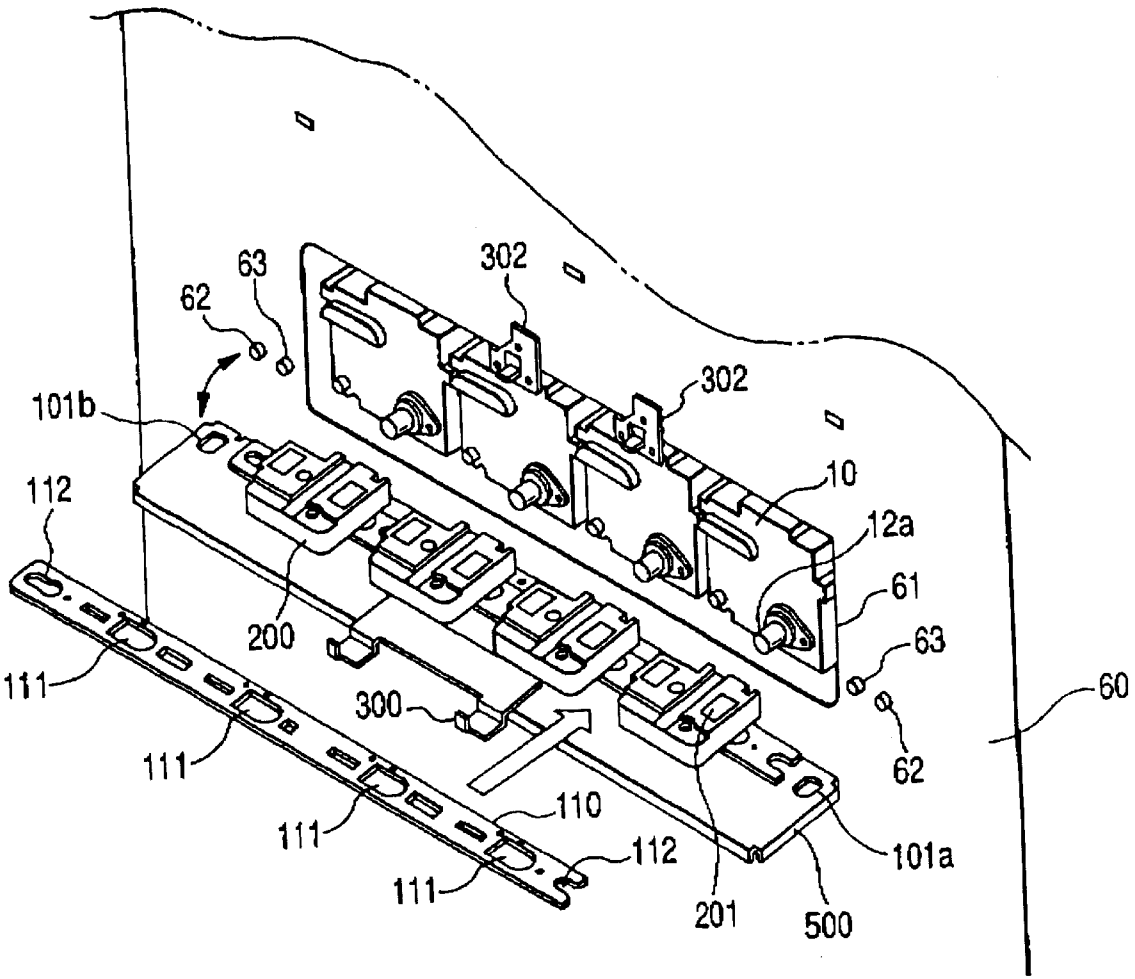
FIG. 6 illustrates an operating plate.

The positioning of the shafts 12*a* of the photosensitive drums 12 will now be described with reference to FIG. 6.

As previously described, the bearing portions 201 are formed on the CRG receivers 200 accurately positioned on the openable and closable cover 100, and by the openable and closable cover unit 500 being closed while during the closing operation of the openable and closable cover unit 500, the bearing portions 201 are fitted to the reference shafts and while the bearing portions 201 are fitted to the shafts 12*a* of the photosensitive drums of the respective process cartridges 10, the positions of the process cartridges 10 in the lateral direction thereof (the direction in which the process cartridges are arranged) are determined with the first reference shafts 62 as the reference. The lateral length of the bearing portions 201 (apertures) of the CRG receivers 200 is equal to or longer by several tens of $\mu$m than the diameter of the shafts and therefore, the lateral position of each shaft 12*a* can be regulated and determined at a predetermined position.

On the other hand, the positioning of each shaft 12*a* in the longitudinal direction thereof (a direction orthogonal to the direction of conveyance of the recording material) in contrast with the aforementioned lateral direction (the direction of conveyance of the recording material) is determined by the operating plate 110 being operated in the left to right direction (the direction in which the process cartridges are arranged) after the lock plates 300 and the lock pawls 302 are engaged with each other and the openable and closable cover unit 500 is locked after the closing operation of the openable and closable cover unit 500.

The operating plate 110 is formed with fitting apertures 111 fitted on the shafts 12*a* of the photosensitive drums 12 so as to correspond to the number of the process cartridges 10. Each of these fitting apertures 111 is formed into a shape like that of a keyhole by a portion larger than the shaft 12*a* of the photosensitive drum and formed so as not to fit on the shaft 12*a* and a portion fitted on the shaft 12*a* of the photosensitive drum. Accordingly, the fitting apertures 111 formed in the operating plate 110 usually do not abut against the shafts 12*a* of the photosensitive drums during the closing operation of the openable and closable cover unit 500. When the second operating lever 410 is operated in the lateral direction thereof from the exterior package side of the openable and closable cover 100 after the openable and closable cover unit 500 has been closed, the fitting portion of each fitting aperture 111 abuts against the shaft 12*a* of each photosensitive drum and is fitted on the shaft of the drum and at the same time, the second reference apertures 112 of the operating plate 10 are fitted on the second reference shafts 63 of the first side plate 60, whereby the positions of the shafts 12*a* of the photosensitive drums are biased in a predetermined direction.

Also, these fitting apertures 111 and the reference apertures 112 of the operating plate are disposed on the same line so as to bias the shafts 12*a* of the photosensitive drums and therefore, when the operating plate 110 is laterally operated, the longitudinal positions of the process cartridges 10 can be determined.

As described above, after the interchange of each process cartridge, the lateral and longitudinal positioning of each shaft 12*a* can be easily effected by a simple operation with the aid of the openable and closable cover unit 500 and therefore, usability can be improved. Further, in the case of a construction in which a portion of the outer wall of the main body of the image forming apparatus is formed by the openable and closable cover unit 500, the interchange of the process cartridges and the positioning of each shaft 12*a* can be done by the use of only the openable and closable cover unit 500 and therefore, usability can be further improved.

As described above, the shafts 12*a* of the photosensitive drums of the process cartridges 10 are positioned by the bearing portions 201 of the CRG receivers 200 which are first holding means had by the openable and closable cover unit 500 mounted with the coupling 95 of the driving unit 90 as the reference and positioned relative to the first side plate 60, and the fitting apertures 111 of the operating plate 110 which are second holding means and therefore, the process cartridges are accurately held in the main body of the color image forming apparatus.

Consequently, the positioning of the process cartridges 10 is readily possible by the operation of the openable and closable cover unit 500, and the provision of an image forming apparatus, in which even if the user directly operates it, it never happens that the process cartridges positionally deviate each time they are detachably mounted, becomes possible.

While in the foregoing, a description has been provided of an example in which the regulation of the position (positioning) of the rotary shaft 12*a* of each photosensitive drum is effected by the openable and closable cover unit, this is not restrictive, but the shafts 12*a* of the rotatable photosensitive drums 12 may be indirectly supported through bearings or the like and the regulation of the positions thereof may be effected. Also, there may be adopted a construction in which a protruding portion is provided on the extension of each rotary shaft 12*a* which is outside the frame of the process cartridge and it is supported and position-regulated (positioned) by the openable and closable cover unit.

Also, while in the foregoing, a process cartridge integrally having a photosensitive drum and as process means for acting on the photosensitive drum, charging means, developing means and cleaning means has been shown as the process cartridge detachably mountable with respect to the image forming apparatus, this is not restrictive, but the process cartridge may be a process cartridge integrably having, for example, one of the aforementioned process means.

Further, while in the aforedescribed embodiment, there has been shown a construction in which process cartridges each comprising a photosensitive drum, etc. are detachably mountable to the image forming apparatus, this is not restrictive, but there may be adopted a construction in which for example, units each having only a photosensitive drum is detachably mountable to the main body of the image forming apparatus.

Also, while in the aforedescribed embodiments, a printer has been shown as the image forming apparatus, the present invention is not restricted thereto, but may be other image forming apparatus such as a copier or a facsimile apparatus, and the present invention can be applied to such image forming apparatus to thereby obtain a similar effect.

Also, while in the aforedescribed embodiment, the process cartridges have been shown as consisting of four colors, i.e., Y, M, C and K, this is not restrictive, but it is possible to form a color image, for example, by only three colors, and in that case, one set of process cartridge may be decreased.

Also, while in the foregoing, the openable and closable cover unit is designed to be pivotally moved about the hinge shaft and opened and closed, this is not restrictive, but the operable and closable cover unit may be designed to be pulled out in the direction of arrow of FIG. 5.

Also, while in the foregoing, a description has been provided of an example in which the direction in which each shaft 12*a* is moved (substantially the vertically upward direction) is orthogonal to the direction of movement of the operating plate (substantially the horizontal direction), this is not restrictive, but the direction of movement of the operating plate can be a direction differing from the direction in which each shaft 12*a* is moved. Also, the present invention can likewise be applied even when the direction in which each shaft 12*a* is moved (for positioning) is not a vertical direction.

Another example of the positioning of the shafts 12*a* of the photosensitive drums 12 will now be described with respect to FIGS. 7 and 8. In the other points of this construction, the present embodiment is the same as the above-described embodiment and therefore need not be described.

Figure 7:
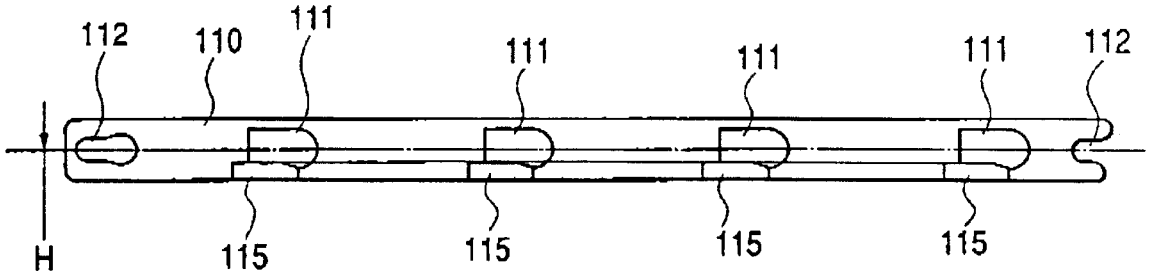
FIG. 7 illustrates an auxiliary member on the operating plate.

As shown in FIG. 7, the operating plate 110 is formed with apertures 111 so as to correspond to the shafts 12*a* of the photosensitive drums 12 of respective process cartridges 10. These apertures 111 are formed larger than the shafts 12*a* of the photosensitive drums 12, and auxiliary members 115 and auxiliary members 116 are mounted below and above, respectively, these apertures 111.

Figure 8A:
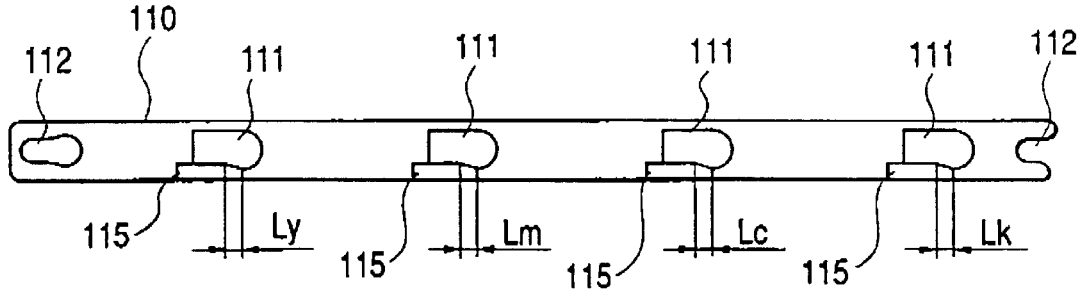
FIGS. 8A and 8B illustrate the auxiliary member on the operating plate.
Figure 8B:
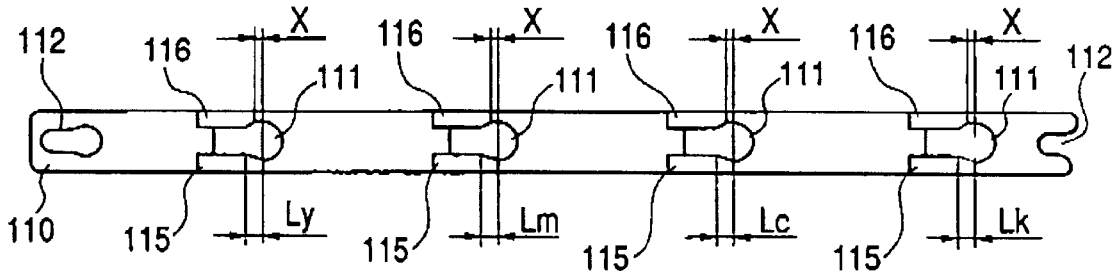

The auxiliary members 115 are designed to raise the shafts 12*a* of the photosensitive drums 12 from below. Also, in order that the shafts 12*a* of the plurality of photosensitive drums 12 may be held at a predetermined height by these auxiliary members 115, as shown in FIG. 7, the auxiliary members 115 are mounted so as to be parallel to a receiving surface height H formed by the reference apertures 112 of the operating plate 110 and the reference shafts 63 and thus, when these auxiliary members 115 raise the shafts 12*a* of the photosensitive drums 12 from below, the shafts 12*a* of the photosensitive drums 12 of the respective process cartridges 10 are all set to a predetermined height. On the other hand, as shown in FIGS. 8A and 8B, the auxiliary members 116 are mounted on the opposite side of the auxiliary members 115, and are set so as to sandwich the raised shafts 12*a* of the photosensitive drums 12 from above. The gap between the auxiliary members 115 and the auxiliary members 116 is made somewhat larger than the diameter of the shafts 12*a* of the photosensitive drums 12.

As described above, the reference apertures 112 and apertures 111 formed in the operating plate 110, and the auxiliary members 115 and auxiliary members 116 mounted on the operating plate 110 are disposed so as to bias the shafts 12*a* of the photosensitive drums 12 on the same line and therefore, when the operating plate 110 is laterally operated, the longitudinal position of the process cartridges 10 can be determined. The lateral position of each process cartridge 10 (each shaft 12*a*) is position-regulated (positioned) by the CRG receiver and therefore, the design is made such that even if the operating plate is laterally moved, the lateral position does not change.

Further, these auxiliary members 115 and auxiliary members 116 will be described with reference to FIGS. 8A and 8B.

As shown in FIGS. 8A and 8B, the auxiliary members 115 for regulating the position of the height of the shafts 12*a* of the photosensitive drums 12 (a direction orthogonal to the direction of movement of that surface of the intermediate transfer member which is in contact with the respective photosensitive drums) receive the weight of the process cartridges at a time when an attempt is made to raise the shafts 12*a* of the photosensitive drums 12 at a time and therefore, the load (operating force) necessary when the operating plate 110 begins to be moved in the left to right direction becomes great. Therefore, each auxiliary member 115 is shifted in the position changing from the inclined surface (second supporting portion) of each auxiliary member 115 freely supporting each shaft 12*a* to a plane (first supporting portion) for regulating (positioning) the position of each shaft 12*a* so that the timing at which the shaft 12*a* of each process cartridge 10 is raised up can be changed.

For example, as shown in FIG. 8A, the shafts 12*a* are constructed such that the length from the position (inclined surface) of each auxiliary member 115 freely supported by each shaft 12*a* to the position (flat surface) thereof regulated by each shaft 12*a* becomes gradually greater in the order of Lk, Lc, Lm and Ly (Lk<Lc<Lm<Ly). That is, the timing at which the shaft 12*a* of each photosensitive drum 12 is raised is varied in such a manner that the shafts 12*a* become gradually delayed to the regulated position in order. Thereupon, even if the operating plate 110 is laterally moved by the aforedescribed second operating lever, the timing at which each process cartridge 10 is raised by each auxiliary member 115 is changed and the operability of the operating plate 110 becomes good, that is, the load at the start of the operation (when the shafts 12*a* start to be moved upwardly by the operating plate) can be lightened, and it becomes possible to easily regulate the positional relation between the shafts 12*a* of the photosensitive drums 12 of the process cartridges 10 and the optical unit 20 into a predetermined positional relation.

Of course, the relation of the length of each auxiliary member 115 changing from the contact starting surface to the flat surface thereof is not restricted to Lk<Lc<Lm<Ly, but any other adopted method would lead to a similar effect if the timing at which each process cartridge 10 is raised is changed.

Even if for example, the length of the auxiliary member 115 changing from the contact starting surface to the flat surface thereof is made constant and the position at which the auxiliary member 115 is mounted on the operating plate 110 is shifted to thereby change the timing at which each process cartridge 10 is raised, a similar effect will be obtained.

This also holds true of the auxiliary members 116 disposed on the side opposite to the auxiliary members 115, and by the timing at which each shaft 12*a* is held down being delayed by like Lk-x (likewise with regard also to Lc, Lm and Ly) as shown, for example, in FIG. 8B so that the shaft 12*a* of each photosensitive drum 12 may be held down after being raised by the auxiliary member 115, the operating force during the operation of the operating plate 110 can be mitigated.

Also, it is more preferable to adopt a construction in which the timing at which each shaft 12*a* is moved upwardly is such that after the first shaft 12*a* has been raised, the raising of the next second shaft 12*a* is started.

As described above, in the present embodiment, the shafts 12*a* of the photosensitive drums 12 of the process cartridges 10 are positioned and accurately held in the color image forming apparatus by the coupling 95 of the driving unit 90, the bearing portions 201 of the CRG receivers 200 of the openable and closable cover unit 500, the apertures 111 of the operating plate 110 and the auxiliary members 115, 116. Consequently, the holding mechanism serving for the longitudinal and lateral positioning of the process cartridges and particularly the longitudinal operability and reproducibility are improved and therefore, the provision of a color image forming apparatus, which is small in image misregistration and good in operability, becomes possible.

Figure 9:
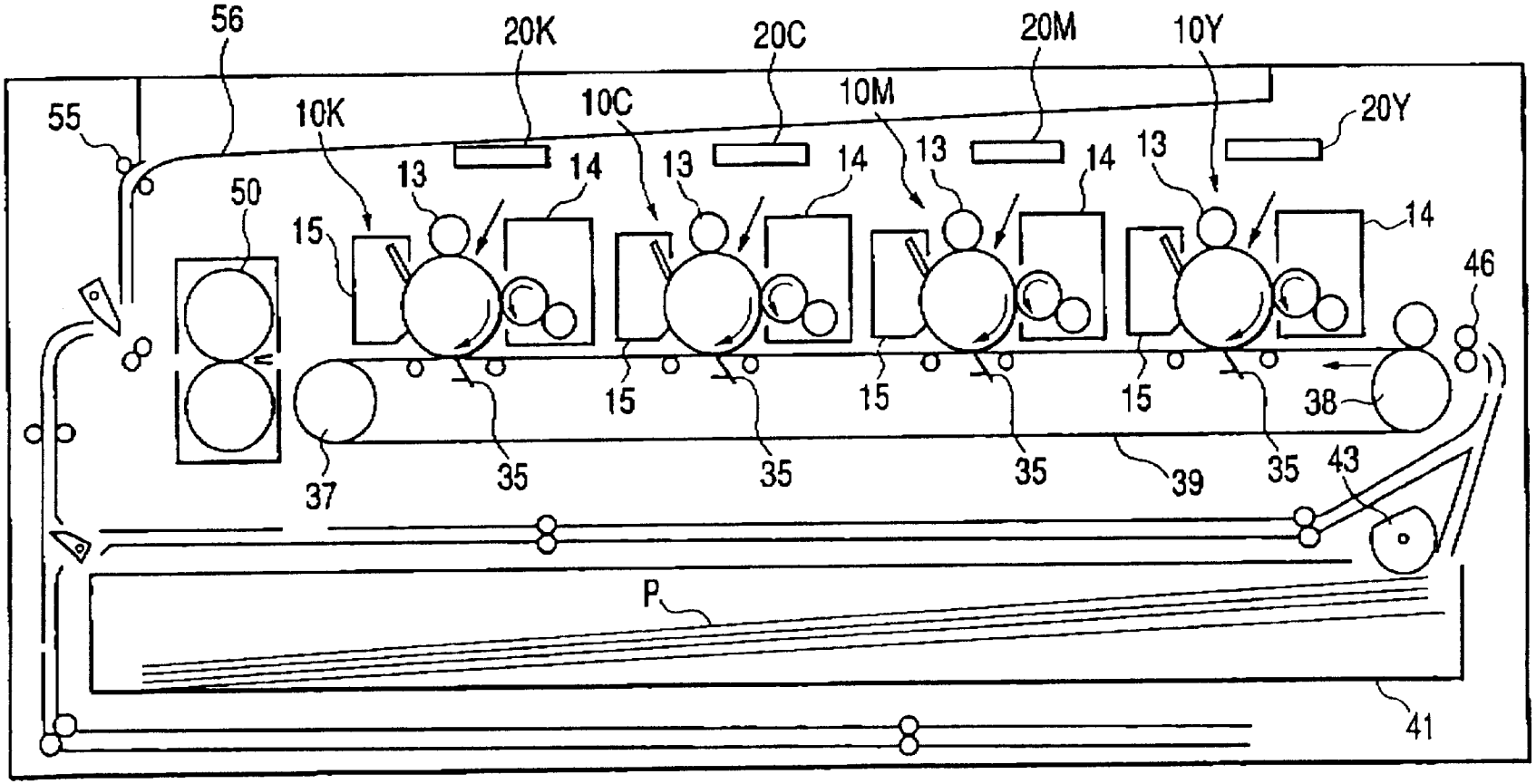
FIG. 9 illustrates another color image forming apparatus.

While in the aforedescribed embodiments, there has been shown an image forming apparatus of a construction in which the images formed on the respective photosensitive drums 12 are sequentially superimposed and transferred to the intermediate transfer member unit 30, and the images superimposed and transferred to the intermediate transfer member unit 30 are collectively transferred to the recording material P, the present invention is not restricted thereto. In FIG. 9, members functionally similar to those in the aforedescribed embodiments are given the same reference characters and need not be described in detail.

For example, in an image forming apparatus as shown in FIG. 9 wherein a recording material P as a transfer medium selectively supplied from a cassette 41 or the like is carried on and conveyed by a transfer belt 39 as conveying means (recording material carrying member) passed over rollers 37 and 38, and toner images of respective colors formed on photosensitive drums 12 in process cartridges 10Y, 10M, 10C and 10K are sequentially superimposed and transferred to the recording material P carried on the transfer belt 39, the present invention can be applied to the construction for positioning the shaft 12*a* of each process cartridge as in the above-described first and second embodiments to thereby obtain a similar effect.

What is claimed is:

1. An image forming apparatus comprising:

a plurality of image bearing member units each provided with an image bearing member, an image on said image bearing member being transferred to a transfer medium; and an openable and closable unit openable and closable to mount and dismount said plurality image bearing member units from a main body of the image forming apparatus, wherein said openable and closable unit regulates a position of each of said image bearing member units.

2. An image forming apparatus according to claim 1, wherein said openable and closable unit regulates a position of a protruding portion provided on each of said plurality of image bearing member units.

3. An image forming apparatus according to claim 2, wherein said openable and closable unit moves said protruding portion to a predetermined position.

4. An image forming apparatus according to claim 2, wherein said protruding portion is provided near a position of a rotary shaft of said image bearing member.

5. An image forming apparatus according to claim 2, wherein said protruding portion is a rotary shaft of said image bearing member.

6. An image forming apparatus according to any one of claims 1 to 5, wherein each of said plurality of image bearing member units is detachably mountable to the main body of the image forming apparatus along a rotational axis of said image bearing member.

7. An image forming apparatus according to any one of claims 1 to 5, the image on said transfer medium transferred from said image bearing member is transferred to a recording material.

8. An image forming apparatus according to any one of claims 1 to 5, further comprising conveying means for bearing thereon and conveying said transfer medium, wherein the image on said image bearing member is transferred to said transfer medium borne on said conveying means.

9. An image forming apparatus according to claim 1, wherein images on said transfer medium sequentially superimposed and transferred from a plurality of image bearing members are transferred to a recording material.

10. An image forming apparatus according to claim 1, further comprising conveying means for bearing thereon and conveying said transfer medium, wherein the images on a plurality of image bearing members are sequentially superimposed and transferred to said transfer medium borne on said conveying means.

11. An image forming apparatus according to claim 1, wherein said openable and closable unit has a single supporting member for supporting protruding portions for movement in a direction orthogonal to a direction of movement of said transfer medium, and said supporting member is movable in a direction differing from a predetermined direction to regulate positions of said protruding portions in said predetermined direction.

12. An image forming apparatus according to claim 11, wherein a timing at which each of said protruding portions supported by said supporting member is moved in said predetermined direction differs.

13. An image forming apparatus according to claim 12, wherein said supporting member is formed with apertures for movably supporting said protruding portions.

14. An image forming apparatus according to claim 13, wherein each of said apertures is provided with a first supporting portion for regulating the position of each of said protruding portions, and a second supporting portion whose position in said predetermined direction differs from that of said first supporting portion.

15. An image forming apparatus according to claim 14, wherein a timing at which each of said protruding portions supported by said supporting member is moved from said second supporting portion to said first supporting portion differs.

16. An image forming apparatus according to claim 15, wherein said first supporting portion is provided on a vertically higher side than said second supporting portion.

17. An image forming apparatus comprising:

a first image bearing member for bearing an image thereon;

a second image bearing member for bearing an image thereon, wherein the images on said first image bearing member and said second image bearing member are sequentially superimposed and transferred to a transfer medium; and a single supporting member for supporting respective supporting shafts of said first image bearing member and said second image bearing member, wherein said supporting member is movable in a direction differing from a predetermined direction to regulate positions of said supporting shafts in said predetermined direction, and wherein a timing at which each of said supporting shafts supported by said supporting member is moved in said predetermined direction differs.

18. An image forming apparatus according to claim 17, wherein said supporting member is formed with apertures for movably supporting said supporting shafts.

19. An image forming apparatus according to claim 18, wherein each of said apertures is provided with a first supporting portion for regulating the position of each of said supporting shafts, and a second supporting portion whose position in said predetermined direction differs from that of said first supporting portion.

20. An image forming apparatus according to claim 19, wherein a timing at which each of said supporting shafts supported by said supporting member is moved from said second supporting portion to said first supporting portion differs.

21. An image forming apparatus according to claim 20, wherein said first supporting portion is provided on a vertically higher side than said second supporting portion.

22. An image forming apparatus according to claim 21, further comprising first exposing means for exposing said first image bearing member after being charged, and second exposing means for exposing said second image bearing member after being charged, wherein the position of each of said supporting shafts is regulated so that a distance between each of said first and said second exposing means and each of said first and said second image bearing members may become a predetermined distance.

23. An image forming apparatus according to any one of claims 17 to 22, wherein said supporting member is movable in a direction orthogonal to said predetermined direction.

24. An image forming apparatus according to claim 23, further comprising a regulating member for regulating the position of each of said supporting shafts in the direction orthogonal to said predetermined direction.

25. An image forming apparatus according to claim 24, wherein said predetermined direction is provided with a vertical direction component.

26. An image forming apparatus according to claim 25, wherein said predetermined direction is a vertical direction.

27. An image forming apparatus according to any one of claims 17 to 22, further comprising a regulating member for regulating the position of each of said supporting shafts in a direction orthogonal to said predetermined direction.

28. An image forming apparatus according to any one of claims 17 to 22, wherein said predetermined direction is provided with a vertical direction component.

29. An image forming apparatus according to any one of claims 17 to 22, wherein after a movement of a first supporting shaft has been completed, a movement of a second supporting shaft is started.

30. An image forming apparatus according to any one of claims 17 to 22, wherein the images on said transfer medium sequentially superimposed and transferred from said first image bearing member and said second image bearing member are transferred to a recording material.

31. An image forming apparatus according to any one of claims 17 to 22, further comprising conveying means for bearing thereon and conveying said transfer medium, wherein the images on said first image bearing member and said second image bearing member are sequentially superimposed and transferred to said transfer medium borne on said conveying means.

32. An image forming apparatus according to any one of claims 17 to 22, wherein said supporting shafts are rotary shafts for transmitting a rotatively driving force to said first image bearing member and said second image bearing member.

33. An image forming apparatus comprising:

a first unit provided with a first image bearing member for bearing an image thereon;

a second unit provided with a second image bearing member for bearing an image thereon, wherein images on said first image bearing member and said second image bearing member are sequentially superimposed and transferred to a transfer medium; and a single supporting member for supporting protruding portions provided on said first unit and said second unit, wherein said supporting member is movable to regulate a position of each of said protruding portions in a predetermined direction, and wherein a timing at which each of said protruding portions supported by said supporting member is moved in said predetermined direction differs.

34. An image forming apparatus according to claim 33, wherein said supporting member is formed with apertures for movably supporting said protruding portions.

35. An image forming apparatus according to claim 34, wherein each of said apertures is provided with a first supporting portion for regulating the position of each of said protruding portions, and a second supporting portion whose position in said predetermined direction differs from that of said first supporting portion.

36. An image forming apparatus according to claim 35, wherein a timing at which each of said protruding portions supported by said supporting member is moved from said second supporting portion to said first supporting portion differs.

37. An image forming apparatus according to claim 36, wherein said first supporting portion is provided on a vertically higher side than said second supporting portion.

38. An image forming apparatus according to claim 37, further comprising first exposing means for exposing said first image bearing member after being charged, and second exposing means for exposing said second image bearing member after being charged, wherein the position of each of said protruding portions is regulated so that a distance between each of said first and said second exposing means and each of said first and said second image bearing members may become a predetermined distance.

39. An image forming apparatus according to any one of claims 33 to 38, wherein said supporting member is movable in a direction orthogonal to said predetermined direction.

40. An image forming apparatus according to claim 39, further comprising a regulating member for regulating the position of each of said protruding portions in the direction orthogonal to said predetermined direction.

41. An image forming apparatus according to claim 40, wherein said predetermined direction is provided with a vertical direction component.

42. An image forming apparatus according to claim 41, wherein said predetermined direction is a vertical direction.

43. An image forming apparatus according to any one of claims 33 to 38, further comprising a regulating member for regulating the position of each of said protruding portions in a direction orthogonal to said predetermined direction.

44. An image forming apparatus according to any one of claims 33 to 38, wherein said predetermined direction is provided with a vertical direction component.

45. An image forming apparatus according to any one of claims 33 to 38, wherein after a movement of a first protruding portion has been completed, a movement of a second protruding portion is started.

46. An image forming apparatus according to any one of claims 33 to 38, wherein the images on said transfer medium sequentially superimposed and transferred from said first image bearing member and said second image bearing member are transferred to a recording material.

47. An image forming apparatus according to any one of claims 33 to 38, further comprising conveying means for bearing thereon and conveying said transfer medium, wherein the images on said first image bearing member and said second image bearing member are sequentially superimposed and transferred to said transfer medium borne on said conveying means.

48. An image forming apparatus according to any one of claims 33 to 38, wherein said protruding portions are provided near positions of centers of gravity of said first and said second units.

49. An image forming apparatus according to any one of claims 33 to 38, wherein said protruding portions are provided near positions of rotary axes of said first and said second image bearing members.

* * * * *

UNITED STATES PATENT AND TRADEMARK OFFICE

CERTIFICATE OF CORRECTION

PATENT NO. : 6,453,136 B1
DATED : September 17, 2002
INVENTOR(S) : Ichiro Yasumaru It is certified that error appears in the above-identified patent and that said Letters Patent is hereby corrected as shown below:

Column 6,
Line 21, “fitted-on” should read -- fitted on --.

Column 8,
Line 26, “cartridge” should read -- cartridges --.

Column 11,
Line 21, “the image” should read -- wherein the image --.

Signed and Sealed this

Thirteenth Day of April, 2004

JON W. DUDAS
*Acting Director of the United States Patent and Trademark Office*